US009343827B2

(12) United States Patent
Hoppmann

(10) Patent No.: US 9,343,827 B2
(45) Date of Patent: May 17, 2016

(54) CONNECTING TERMINAL WITH A WEB-SHAPED CONDUCTOR GUIDE

(71) Applicant: Ralph Hoppmann, Bad Oeynhausen (DE)

(72) Inventor: Ralph Hoppmann, Bad Oeynhausen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 1 day.

(21) Appl. No.: 14/361,725

(22) PCT Filed: Nov. 30, 2012

(86) PCT No.: PCT/EP2012/004967

§ 371 (c)(1),
(2) Date: May 30, 2014

(87) PCT Pub. No.: WO2013/079221

PCT Pub. Date: Jun. 6, 2013

(65) Prior Publication Data

US 2014/0287630 A1 Sep. 25, 2014

(30) Foreign Application Priority Data

Dec. 1, 2011 (DE) ..... 10 2011 055 919

(51) Int. Cl.
*H01R 4/48* (2006.01)

(52) U.S. Cl.
CPC ..... *H01R 4/48* (2013.01); *H01R 4/4809* (2013.01); *H01R 4/4818* (2013.01); *Y10T 29/4922* (2015.01)

(58) Field of Classification Search
CPC ..... H01R 4/48; H01R 4/4809; H01R 4/4818; H01R 4/4827; H01R 4/4845
USPC ..... 439/729, 259, 733.1, 441
See application file for complete search history.

(56) References Cited

U.S. PATENT DOCUMENTS

| | | | | |
|---|---|---|---|---|
| 7,287,999 | B2 * | 10/2007 | Holterhoff | H01R 4/4836 439/441 |
| 7,896,685 | B2 | 3/2011 | Eppe et al. | |
| 2005/0042912 | A1 | 2/2005 | Drewes et al. | |
| 2005/0245143 | A1 | 11/2005 | Eppe et al. | |
| 2007/0072481 | A1 | 3/2007 | Edenharter | |
| 2007/0099479 | A1 * | 5/2007 | Holterhoff | H01R 4/4836 439/441 |
| 2008/0233782 | A1 * | 9/2008 | Hoppmann | H01R 4/4827 439/259 |
| 2008/0248699 | A1 | 10/2008 | Schafer et al. | |
| 2012/0264339 | A1 * | 10/2012 | Brand | H01R 4/4827 439/733.1 |
| 2014/0127932 | A1 * | 5/2014 | Hoppmann | H01R 4/4827 439/370 |

FOREIGN PATENT DOCUMENTS

| | | | |
|---|---|---|---|
| CN | 1591983 | A | 3/2005 |
| DE | 1765478 | A | 7/1971 |
| DE | 10355195 | B4 | 7/2005 |

(Continued)

*Primary Examiner* — Chandrika Prasad

(74) *Attorney, Agent, or Firm* — Leydig, Voit & Mayer, Ltd.

(57) ABSTRACT

A connecting terminal includes a housing, a current rail, and a spring clamp. The housing includes a conductor inlet opening configured to receive a conductor to be clamped. The housing also includes a conductor guide configured to guide the conductor to be clamped. The conductor guide includes a web-shaped extension of the conductor inlet opening and extends from the conductor inlet opening in an insertion direction of the conductor to be clamped. The current rail and the spring clamp are disposed in the housing.

7 Claims, 4 Drawing Sheets

(56) References Cited

FOREIGN PATENT DOCUMENTS

| | | | |
|---|---|---|---|
| DE | 102004047147 | A1 | 4/2006 |
| DE | 202006009460 | U1 | 3/2007 |
| DE | 102005045596 | B3 | 6/2007 |
| DE | 102006047254 | B3 | 5/2008 |
| DE | 202009002324 | U1 | 7/2010 |
| DE | 202010003385 | U1 | 4/2011 |
| EP | 1575130 | A1 | 9/2005 |
| JP | 4476916 | B2 | 6/2010 |
| JP | 201182102 | A | 4/2011 |
| WO | WO 2007042157 | A1 | 4/2007 |
| WO | WO 2011047740 | A1 | 4/2011 |

* cited by examiner

CONNECTING TERMINAL WITH A WEB-SHAPED CONDUCTOR GUIDE

CROSS-REFERENCE TO RELATED APPLICATIONS

This application is a U.S. National Phase application under 35 U.S.C. §371 of International Application No. PCT/EP2012/004967, filed on Nov. 30, 2012, and claims benefit to German Patent Application No. DE 10 2011 055 919.1, filed on Dec. 1, 2011. The International Application was published in German on Jun. 6, 2013, as WO 2013/079221 A1 under PCT Article 21 (2).

FIELD

The invention relates to a connecting terminal having a housing, a current rail arranged in the housing and a spring clamp arranged in the housing, a conductor inlet opening being formed in the housing, via which opening a conductor to be clamped can be inserted. The invention also relates to a method for producing a connecting terminal.

BACKGROUND

A connecting terminal designed in such a way serves to clamp a conductor to a current rail by means of a spring clamp in order to produce an electrical connection. When inserting the conductor to be clamped into the housing of the connecting terminal it can happen that the conductor slips and slides next to the spring clamp or the current rail in the process and thus the electrical connection between the conductor and the current rail is prevented. In order to avoid this, forming a window on the current rail or the spring clamp is known, by means of which the conductor to be clamped is to be guided reliably, and also providing a protrusion on the current rail or spring clamp respectively in the region of the window, which serves as a guide for the conductor. A connecting terminal designed in such a way is known, for example, from DE 10 2005 045 596 B3. The disadvantage here is that as a result of the special design of the current rail or spring clamp respectively, the production complexity of the current rail or spring clamp respectively and thus of the whole connecting terminal are very high, as a result of which the costs of the production of the connecting terminal also increase. Moreover, a current rail or spring clamp respectively formed in such a way requires more space, thus likewise increasing the dimensions of the connecting terminal.

SUMMARY

In an embodiment, the present invention provides a connecting terminal. The connecting terminal includes: a housing including a conductor inlet opening configured to receive a conductor to be clamped, the housing including a conductor guide configured to guide the conductor to be clamped. The conductor guide includes a web-shaped extension of the conductor inlet opening and extending from the conductor inlet opening in an insertion direction of the conductor to be clamped. A current rail is disposed in the housing. A spring clamp is disposed in the housing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
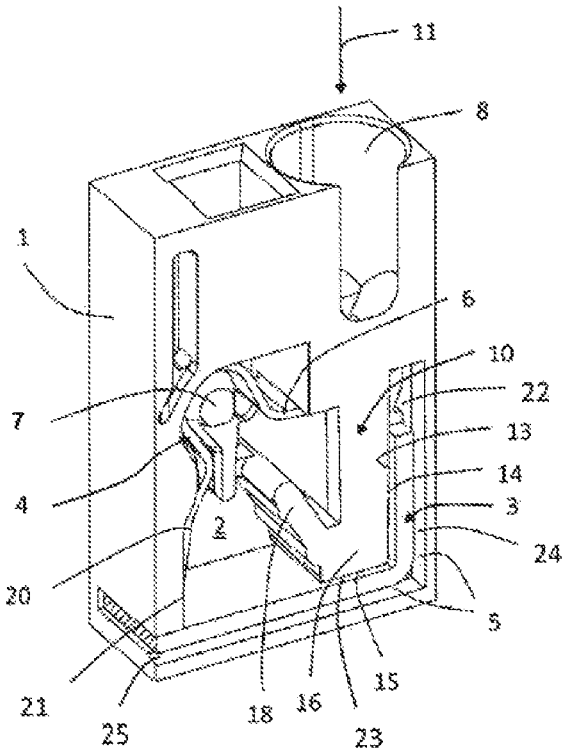
FIG. 1 shows a schematic view of a connecting terminal according to the invention in a first view.

An aspect of the present invention is to promote the reliable clamping of a conductor in a connecting terminal without the production complexity and therefore the production costs of the connecting terminal rising.

According to an embodiment of the present invention, the connecting terminal has a conductor guide for the conductor to be clamped, which is designed in the form of a web-shaped extension of the conductor inlet opening, which extends from the conductor inlet opening in the insertion direction of the conductor to be clamped, the conductor guide being formed integrally with the housing.

In the case of a method for producing a connecting terminal, an embodiment of the present invention includes injection moulding of a housing with a conductor inlet opening formed in the housing and a conductor guide formed integrally with the housing in the form of a web-shaped extension of the conductor inlet opening, which extends from the conductor inlet opening in the insertion direction of the conductor to be clamped, insertion of a current rail into the housing and insertion of a spring clamp into the housing.

The connecting terminal according to an embodiment of the present invention includes a conductor guide, which ensures the reliable guiding of a conductor to be clamped inside the housing, which is preferably open towards one side, the conductor guide not being formed on the current rail or the spring clamp but rather directly on the housing. The conductor guide, which extends in the conductor insertion direction, is web-shaped and constitutes a one-sided extension of the conductor inlet opening in that the conductor guide is directly attached to the conductor inlet opening and covers or closes a part or a region of the side opening in the housing. When a conductor to be clamped is inserted, the conductor can therefore be reliably guided by the conductor guide into the clamping region formed by the spring clamp and the current rail directly after passing through the conductor inlet opening, despite the housing which is open at the side, such that an incorrect installation of the conductor in the connecting terminal can be prevented. When such a connecting terminal is manufactured, the production of the conductor guide can take place at the same time as the formation of the whole housing during an injection moulding process, as a result of which the connecting terminal can be produced quickly and simply, subsequent to the injection moulding of the housing with the conductor guide, only the current rail and the spring clamp now having to be inserted into the housing in order to form the connecting terminal, it being possible in the process for the current rail and the spring clamp preferably to be inserted into the housing from the side via the side opening in the housing. Compared to the construction of a conductor guide on the current rail or a spring clamp, as known from the prior art, both the complexity and cost of production can be reduced by the solution according to the invention. Moreover, a narrow strip can thus preferably be used as the current rail in the case of a connecting terminal according to the invention and moreover the transportation of the current rail in a stamping tool during the production of the current rail to be used can be reduced. As a result of the integral formation of the conductor guide with the housing, the conductor guide is preferably formed from the same material as the housing.

According to a preferred embodiment of the connecting terminal, the conductor guide is formed such that it laterally borders a clamping region between a clamping member of the spring clamp and the current rail, and the clamping member of the spring clamp is securely held in the housing by means of the conductor guide. It is preferably provided for the conductor guide to form a border of the clamping region formed by the spring clamp and the current rail in which region the conductor is clamped to the current rail by means of the clamping member of the spring clamp. The clamping member of the spring clamp and the lateral face of the current rail, to which the conductor is clamped are preferably located opposite one another such that the conductor guide in the form of a web is arranged off-centre between the clamping member of the spring clamp and the current rail. The conductor to be clamped is inserted from above into the clamping region between the clamping member and the current rail, the conductor being guided along the longitudinal extension of the conductor guide. A lateral slipping or sliding of the conductor to be clamped, out of the clamping region, can thus be prevented by the conductor guide. In order to be able to ensure a particularly reliable guiding of the conductor, it is preferably provided for the conductor guide to project above the clamping region and not end in the region of the clamping region. Furthermore, the conductor guide is preferably constructed such that the conductor guide also acts as a retention element for the spring clamp in the housing. This is achieved in that the spring clamp is moved with its clamping member behind the conductor guide and thus the spring clamp can be prevented from slipping forwards out of the housing. In addition, when inserting the spring clamp into the housing, the spring clamp, which is preferably designed in the form of a leg spring, is pressed together and then laterally inserted pressed together into the housing. By being pressed together, the spring clamp can be guided past the conductor guide via the side opening in the housing. As soon as the spring clamp has been positioned in the desired position inside the housing, the spring clamp is released such that the clamping member can position itself behind the conductor guide such that the spring clamp is held in the housing by means of the conductor guide and the spring clamp can be prevented from slipping within the housing by means of the conductor guide.

In order to be able to ensure the reliable positioning of the current rail in the housing as well, it is preferably provided for the current rail to be fastened to the conductor guide via a latching mechanism. The current rail can, for example, be hooked or snapped onto the conductor guide via the latching mechanism. The current rail can thus be held in a fixed position relative to the conductor guide.

Furthermore, it is preferably provided for the current rail to be substantially L-shaped. As a result of the L-shaped form of the current rail, the current rail can be arranged in a particularly space-saving manner in the housing, the current rail preferably being arranged along an interior wall of the housing. Because of the space-saving arrangement of the current rail, the whole connecting terminal can be formed more compactly with smaller dimensions, as a result of which the necessary installation space for a connecting terminal can be reduced.

A further preferred configuration of the connecting terminal according to the invention provides for a spring limiting element to be moulded to the conductor guide. The spring limiting element acts as a stop for the clamping member of the spring clamp when the clamping member is bent outwards during the insertion of the conductor into the clamping region and/or the release of the conductor out of the clamping region. The maximum deflection of the clamping member of the spring clamp can thus be reduced by activating it with a conductor or a release tool, which prevents the clamping member from being able to be pressed as far as the assembly opening. As a result of the possible reduced deflection of the clamping member, the conductor can be introduced and released faster such that the required time for clamping the conductor and/or releasing the conductor can be reduced. The longitudinal axis of the spring limiting element preferably projects at an angle, preferably at an angle of between 20° and 60°, from the longitudinal axis of the web-shaped conductor guide. The spring limiting element is preferably designed in the shape of a finger and moulded onto a free end of the web-shaped conductor guide, which free end is located opposite the conductor inlet opening.

Furthermore, in order to increase the stability of the web-shaped conductor guide, it is preferably provided for the conductor guide to have at least two connection points with the housing. A first connection point is preferably provided on the moulding of the web-shaped conductor guide on the housing bordering the conductor inlet opening. A second connection point can, for example, be provided at the free end of the web-shaped conductor guide opposite the conductor inlet opening. It is, however, also possible, for example, to provide the second or an additional connection point of the conductor guide with the housing via the spring limiting element, in that the spring limiting element is connected to the housing and thus preferably formed integrally with the housing. As a result of the two or more connection points, the production of the conductor guide and therefore the production of the connecting terminal can also be improved since as a result of the plurality of connecting points, a collapse of the injection moulded material in the region of the conductor guide can be prevented. The conductor guide is preferably connected integrally to the housing directly or via an additional element at every provided connection point.

Moreover, it is preferably provided for the current rail to be inserted in a clearance or gap formed between the conductor guide and an interior wall of the housing. As a result of this, a simple installation of the current rail in the housing can be guaranteed in that the current rail can easily be inserted into a region between the interior wall of the housing and the conductor guide via the side opening in the housing. The installation of the current rail in the housing is thus not hindered by the conductor guide, which is formed integrally with the housing.

Figure 2:
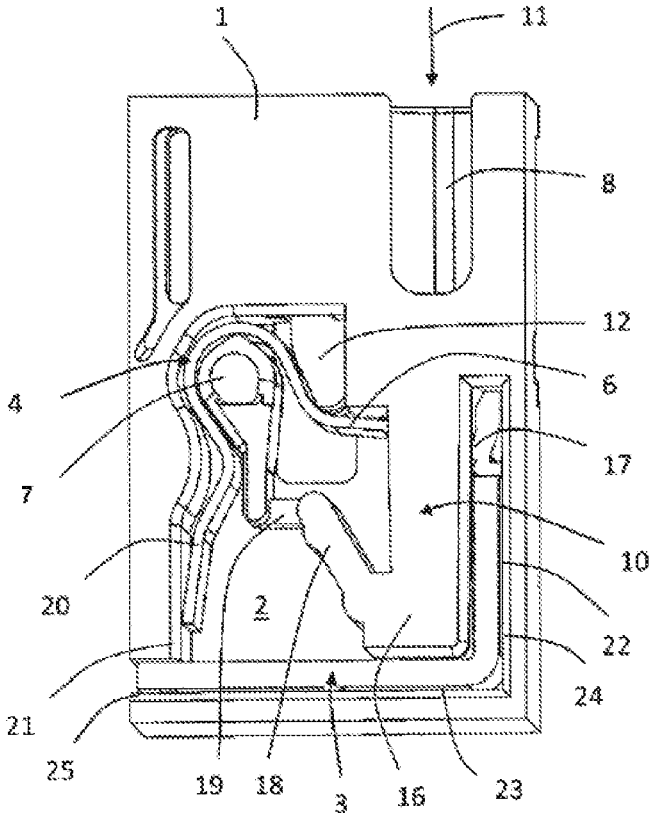
FIG. 2 shows a schematic view of a connecting terminal according to the invention in a second view.
Figure 4:
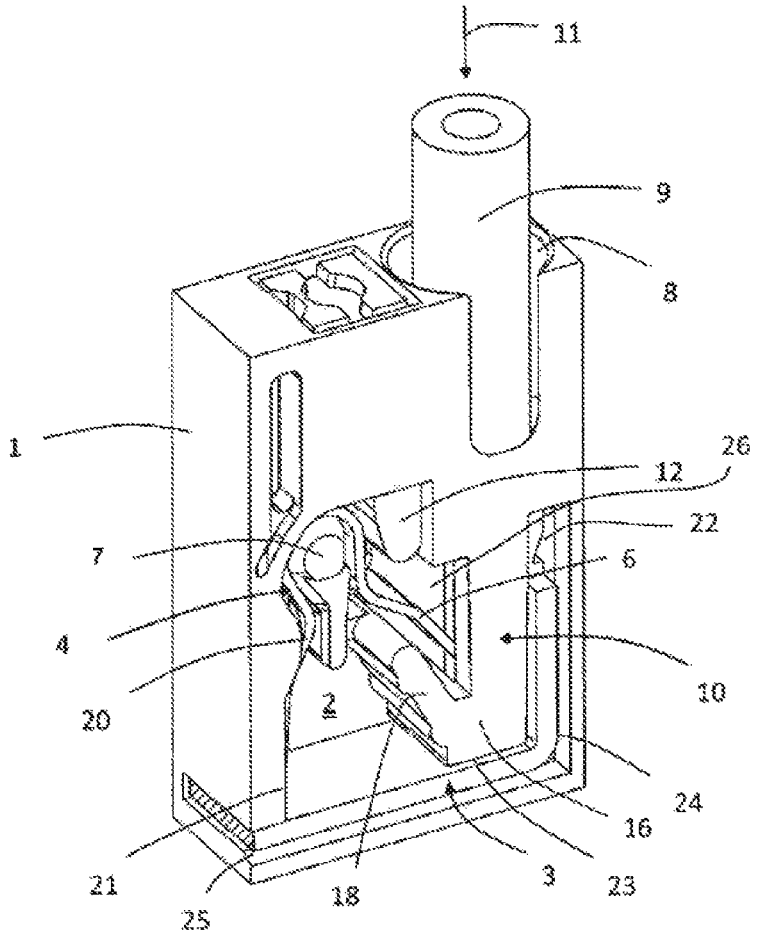
FIG. 4 shows a schematic view of a connecting terminal according to the invention with a conductor inserted.

FIGS. 1, 2 and 4 show a schematic view of a connecting terminal according to the invention. The connecting terminal has a housing 1 with an interior clearance 2, a current rail 3 and a spring clamp 4 being arranged in the interior clearance 2 of the housing 1.

The current rail 3 is formed from a narrow metal band and bent in the shape of an L. In its state when inserted into the housing, as shown in FIG. 1, the current rail 3 is positioned against an interior wall 5 of the housing 1. As can be seen in FIG. 1, the housing 1 has an opening 21 on one longitudinal lateral face, so that the housing is open at the side. The housing 1 is thus a housing 1 that is open on one side. The current rail 3 is inserted into the housing via this side opening 21.

The spring clamp 4 is designed in the form of a leg spring with a retention leg 20 and a clamping member 6. The spring clamp 4 is pushed open onto a retention element 7 formed in the housing 1, which retention element is preferably formed integrally with the housing 1. In order to slide the spring clamp 4 onto the retention element 7, the spring clamp 4 is also inserted into the housing 1 via the side opening 21.

In the housing 1 itself, a conductor inlet opening 8 is formed, via which a conductor 9 to be clamped, as shown in FIG. 4, can be inserted in order to be clamped against the current rail 3 by means of the clamping member 6 of the spring clamp 4.

Furthermore, the connecting terminal has a conductor guide 10 for the conductor 9 to be clamped, which guide is designed in the form of a web and formed beneath the conductor inlet opening 8 such that the conductor guide 10 is designed in the form of a web-shaped extension of the conductor inlet opening 8. The conductor guide 10 extends, starting from the conductor inlet opening 8 in the insertion direction 11 of the conductor 9 to be clamped, into the interior clearance 2 of the housing 1. The conductor guide 10 is designed on one side in the form of a thin web projecting from the conductor inlet opening 8, the conductor guide 10 being formed integrally with the housing 1 such that the conductor guide 10 can be formed together with the housing 1 during an injection moulding process. The conductor guide 10 is formed in the region of the side opening 21 in the housing 1, so that the conductor guide 10 covers or closes the side opening 21 in the housing 1 in part or in some regions.

The conductor guide 10 is formed such that it laterally borders, in the direction of the side opening 21 in the housing 1, a clamping region formed between the clamping member 6 and the current rail 3. The clamping member 6 of the spring clamp 4 and the lateral face 13 of the current rail 3, to which the conductor 9 is clamped, are located opposite one another such that the conductor guide 10 in the form of a web is arranged off-centre between the clamping member 6 of the spring clamp 4 and the current rail 3. The conductor 9 to be clamped is inserted from above into the clamping region between the clamping member 6 and the current rail 3, the conductor 9 being guided along the longitudinal extension of the conductor guide 10. A lateral slipping or sliding of the conductor 9 to be clamped, out of the clamping region, can thus be prevented by the conductor guide 10. The conductor guide 10 is formed in its longitudinal extension to be of such a length that it projects above the clamping region and does not end in the region of the clamping region.

The conductor guide 10 also acts as a retainer for the spring clamp 4 since the spring clamp 4 is prevented from sliding forwards from the retention element 7 by the conductor guide 10 since the clamping member 6 of the spring clamp 4 is arranged behind the conductor guide 10 and can be activated there by means of the conductor 9 or a release tool, for example a trigger 12, as shown in FIG. 4.

The conductor guide 10 is formed at a distance from the interior wall 5 of the housing 1, such that a clearance or gap 22 is formed between the longitudinal side 14 of the conductor guide 10, which side points towards the interior wall 5 of the housing 1, and the interior wall 5 of the housing 1 in the clamping direction of the clamping member 6 of the spring clamp, as well as a clearance or gap 23 between the short side 15 of the free end 16 of the conductor guide 10 and the interior wall 5, formed as the floor surface, of the housing 1 in the conductor insertion direction 11. The current rail 3 can be inserted into the housing 1 via the gap 22 and the gap 23 between the conductor guide 10 and the interior wall 5 of the housing 1.

The interior wall of the housing 1 has an insertion chamfer on each of its edges 24, 25 adjoining the side opening 21 in order to facilitate the insertion of the current rail 3 into the gap 22 and the gap 23.

In its inserted state, the current rail 3 is fastened to the longitudinal side 14 of the conductor guide 10 via a latching mechanism 17, as shown in FIG. 2, such that the conductor guide 10 can also serve to securely fix the current rail 3 inside the housing 1.

At the free end 16 of the conductor guide 10, a spring limiting element 18 is formed, which is preferably integrally moulded on the conductor guide 10 such that the spring limiting element 18 can also be formed directly during the injection moulding of the housing 1. The spring limiting element 18, which limits the maximum deflection of the clamping member 6 of the spring clamp 4, is designed in the form of a finger, which projects at an angle of substantially 90° relative to the web-shaped conductor guide, into the interior clearance 2 of the housing 1. Moreover, the spring limiting element 18 projects at an angle, preferably at an angle of between 20° and 60°, from the longitudinal axis of the web-shaped conductor guide 10.

As can be seen in FIG. 2, the spring limiting element 18 is connected to the retention element 7 via a web 19 such that, in addition to the connection point of the conductor guide 10 to the housing 1 in the region of the conductor inlet opening 8, the conductor guide 10 is connected to the housing 1 via the spring limiting element 18, the web 19 and the retention element 7 and as a result of this a second connection point of the conductor guide 10 with the housing 1 is formed. An integral design with the housing 1 is preferably provided at the two connection points.

Figure 3:
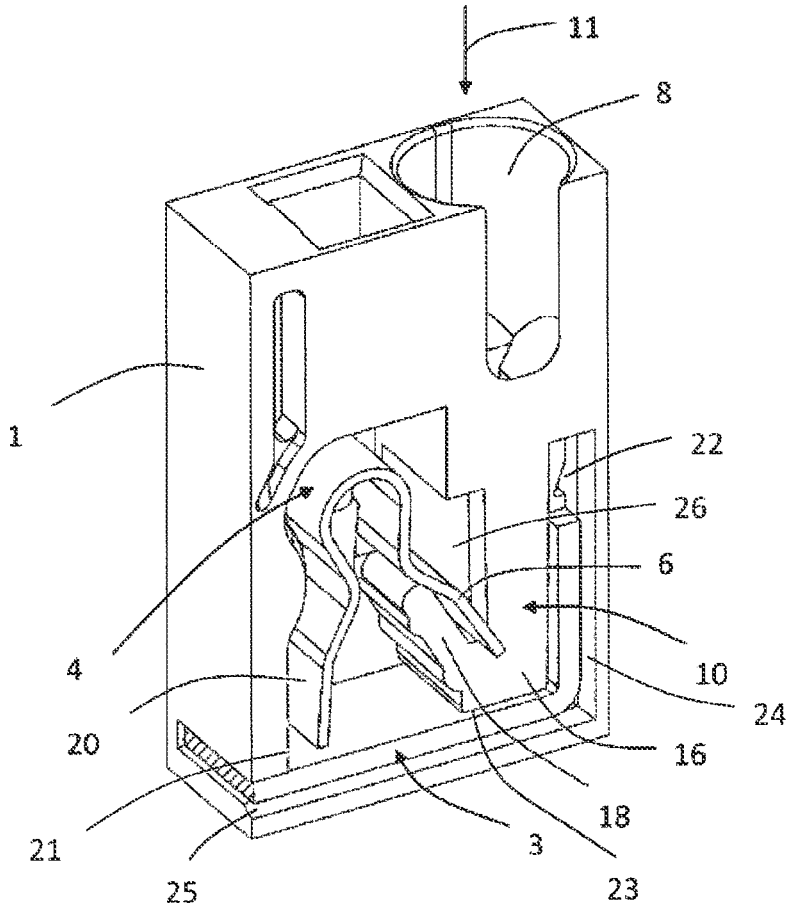
FIG. 3 shows a schematic view of a connecting terminal according to the invention during the assembly of the spring clamp.

Furthermore, in FIG. 3 a step to produce a connecting terminal is shown, in which the spring clamp 4 is inserted into the housing 1 from the side via the opening 21. When being inserted into the housing 1, the spring clamp 4 is pressed together and inserted pressed together into the housing 1 via the side opening 21. As a result of the spring clamp 4 being pressed together, it can be guided past the conductor guide 10 through a clearance 26 which is formed between the conductor guide 10 and the spring limiting element 18 and is part of the side opening 21, as shown in FIG. 3. As soon as the spring clamp 4 is positioned in the required position inside the housing 1, the spring clamp 4 is released again such that the clamping member 6 of the spring clamp 4 can position itself behind the conductor guide 10, as can be seen in particular in FIG. 1, such that the spring clamp 4 is held in the housing 1 by means of the conductor guide 10 and a slipping of the spring clamp 4 inside the housing 1 can be prevented by means of the conductor guide 10.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Housing 1
Interior clearance 2
Current rail 3
Spring clamp 4
Interior wall 5
Clamping member 6
Retention element 7
Conductor inlet opening 8
Conductor 9
Conductor guide 10
Insertion direction 11
Trigger 12
Lateral face 13
Longitudinal side 14
Short side 15
Free end 16
Latching mechanism 17
Spring limiting element 18
Web 19
Retention leg 20
Opening 21
Gap 22
Gap 23
Edge 24
Edge 25
Clearance 26

The invention claimed is:

1. A connecting terminal comprising:

a housing including a conductor inlet opening configured to receive a conductor to be clamped, the housing having an interior wall, the housing including a conductor guide configured to guide the conductor to be clamped, the conductor guide including a web-shaped extension of the conductor inlet opening and extending from the conductor inlet opening in an insertion direction of the conductor to be clamped, the conductor guide having a free end located opposite the conductor inlet opening, the free end having a short side, and the conductor guide having a longitudinal side that points toward the interior wall;

a current rail disposed in the housing; and a spring clamp disposed in the housing, wherein the conductor guide is formed at a distance from the interior wall such that a first gap is formed between the interior wall and the longitudinal side of the conductor guide and a second gap is formed between the interior wall and the short side of the free end of the conductor guide, and wherein the current rail is disposed in the housing in the first gap and the second gap.

2. The connecting terminal as recited in claim 1, wherein the conductor guide laterally borders a clamping region between a clamping member of the spring clamp and the current rail, the clamping member of the spring clamp being securely held in the housing by the conductor guide.

3. The connecting terminal as recited in claim 1, wherein the current rail is fastened to the conductor guide via a latching mechanism.

4. The connecting terminal as recited in claim 1, wherein the current rail is substantially L-shaped.

5. The connecting terminal as recited in claim 1, wherein a spring limiting element is moulded onto the conductor guide.

6. The connecting terminal as recited in claim 1, wherein the conductor guide has at least two connection points with the housing.

7. The connecting terminal as recited in claim 1, wherein the current rail is disposed in a clearance formed between the conductor guide and the interior wall of the housing.

* * * * *